US006041764A

United States Patent [19]

Nemoto et al.

[11] Patent Number: 6,041,764

[45] Date of Patent: Mar. 28, 2000

[54] EXHAUST CIRCULATION CONTROL VALVE FOR AUTOMOTIVE ENGINES

[75] Inventors: Hirotomi Nemoto; Takeshi Gomi; Hidetoshi Oishi, all of Wako, Japan

[73] Assignee: Honda Giken Kogyo Kabushiki Kaisha, Tokyo, Japan

[21] Appl. No.: 09/100,972

[22] Filed: Jun. 22, 1998

[30] Foreign Application Priority Data

Jun. 23, 1997 [JP] Japan ..... 9-180241

[51] Int. Cl.[7] ..... F02M 25/07

[52] U.S. Cl. ..... 123/568.2

[58] Field of Search ..... 123/568.2; 60/605.2; 137/601

[56] References Cited

U.S. PATENT DOCUMENTS

| | | | |
|---|---|---|---|
| 3,934,564 | 1/1976 | Barnert | 123/568.2 |
| 4,041,913 | 8/1977 | Nohira | 123/568.2 |
| 4,048,967 | 9/1977 | Stumpp | 123/568.2 |
| 4,171,688 | 10/1979 | Takahashi | 123/568.2 |
| 4,350,013 | 9/1982 | Yoshiba | 123/568.2 |
| 4,366,799 | 1/1983 | Suda | 123/568.2 |

FOREIGN PATENT DOCUMENTS 56-30681 7/1981 Japan .

*Primary Examiner*—Willis R. Wolfe

*Attorney, Agent, or Firm*—Armstrong, Westerman, Hattori, McLeland & Naughton

[57] ABSTRACT

An object of the present invention is to provide an exhaust circulation control valve having a simple structure and having both high-precision low-flow control characteristics and responsive large-flow control characteristics. In an exhaust circulation control valve 1, there are disposed an exhaust gas inlet port 6 for letting in exhaust gas from an exhaust gas path 2 of an engine E and an exhaust gas feed port 7 feeding the exhaust gas to an inlet path 3. Exhaust gas inlet port 6 and feed port 7 are made continuous with each other via coaxially disposed first and second openings 11, 12. First and second valve bodies 15, 16 are disposed on openings 11, 12 respectively in order to open and close the openings. First valve 15 is controlled by a drive mechanism 17 based on the operating state of engine E. Second valve 15 is kept in a closed state by a spring 19. Thus, when the lift on first valve 15 is small, exhaust gas flows only through first opening 11. When there is a large lift at valve 15, however, second valve 16 is activated as well, and the exhaust gas flows through both first and second openings 11, 12.

7 Claims, 2 Drawing Sheets

EXHAUST CIRCULATION CONTROL VALVE FOR AUTOMOTIVE ENGINES

BACKGROUND OF THE INVENTION

1. Field of the Invention

The present invention relates to an exhaust circulation control valve for automotive engines where the amount of exhaust gas recirculated in the inlet system of an engine is controlled. More specifically, the present invention relates to an exhaust gas circulation control valve having an exhaust gas inlet port for letting in exhaust gas and an exhaust gas feed port for introducing the exhaust gas into the inlet system. An aperture is formed to make the ports continuous. The opening and closing of the aperture is controlled by the lift of the valve.

2. Description of the Related Art

In automotive engines, exhaust gas recirculation (EGR) is used to reduce the emission of nitrogen oxides. A portion of the exhaust gas generated in the combustion chamber is returned to the inlet system and added to newly introduced air. With this type of EGR system, circulation of exhaust gas that is excessive with regard to the state of the engine can result in unstable combustion and a significant decrease in engine output. If circulation is inadequate, it is not possible to take full advantage of EGR. Thus, in order to use EGR efficiently and provide optimum emission characteristics and fuel consumption, it is necessary to control the amount of recirculated exhaust gas in a manner corresponding to the engine state. This type of control is generally performed via an exhaust gas circulation control valve disposed in an exhaust gas circulation path connecting the exhaust system and the inlet system of an engine. In this type of exhaust gas circulation control valve, an exhaust gas inlet port connected to the exhaust gas path of the engine and an exhaust gas feed port connected to the inlet path of an engine are made continuous via an opening disposed between the two ports. The area of the opening is made variable via the lift of the valve.

In order to provide appropriate control over a wide range of engine states, an exhaust gas circulation control valve must have flow control properties that vary according to the operating state of the engine. For example, when an automobile is running normally, a small amount of exhaust gas must be controlled and circulated with a high degree of precision. On the other hand, a large amount of exhaust gas should be circulated during acceleration, so the exhaust gas circulation control valve must be responsive to large flows as well.

In order to fulfill these requirements, Japanese Examined Patent Publication Number 56-30681 proposes a structure wherein an exhaust gas inlet port and an exhaust gas feed port are made continuous via two openings disposed between the two ports. Valves for each of these openings are opened and closed separately. These valves are driven by separate drive mechanisms.

With this type of exhaust gas circulation valve, large amounts of exhaust gas can be circulated (e.g., during acceleration of the automobile) by opening both openings. Also, when high engine output is required (e.g., when going up a hill), a small amount of exhaust gas can be controlled and circulated with a high degree of precision by closing one of the valves. Thus, the exhaust gas circulation control valve can handle different flow control properties.

However, with the exhaust gas control valve described above, two valves must be driven by separate external drive mechanisms. This makes the overall valve system, including the drive mechanisms, large and complex. Also, the margin of error generated by each drive mechanism makes maintaining a high degree of precision difficult.

Furthermore, with exhaust gas circulation control valves, the adhesion of carbon to the valves is a problem, and the structure described above does not address this problem.

SUMMARY OF THE INVENTION

The present invention seeks to overcome the problems described above. A first object of the present invention is to provide a compact, high-precision exhaust circulation control valve that exhibits different flow control characteristics depending on the operating state of the engine.

Another object of the present invention is to provide an exhaust circulation control valve that significantly reduces the adhesion of carbon.

In order to achieve the objects described above, the present invention involves a structure wherein openings are disposed at a plurality of positions between an exhaust gas inlet port and an exhaust gas outlet port to make the two ports continuous. Valves for each of the openings are disposed to open and close the openings. When one of the valves is operated above a prescribed lift, this valve activates another valve.

It would be desirable to have the valves disposed roughly along the same axis as the direction in which the valves operate.

In this configuration, when the lift of the valve is relatively small, the valve will be controlling the opening and closing of only one opening. Thus, the flow from the exhaust gas inlet port to the exhaust port can be restricted to a small amount. When the valve lift is large and there is a large flow of exhaust gas, the valve activates another valve so that another opening is opened as well, thus increasing the flow of exhaust gas. As a result, the exhaust circulation control valve system is able to provide both high-precision low-flow control characteristics as well as large-flow control characteristics.

If the valves are disposed coaxially in this configuration, a large lift at a single valve results in the valve coming into contact with and activating another valve. This provides a very simple mechanism for driving valves in tandem. Furthermore, the impact resulting from the contact between the valves causes carbon adhered to the valves to peel away. Thus, it is possible to reduce carbon adhesion.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
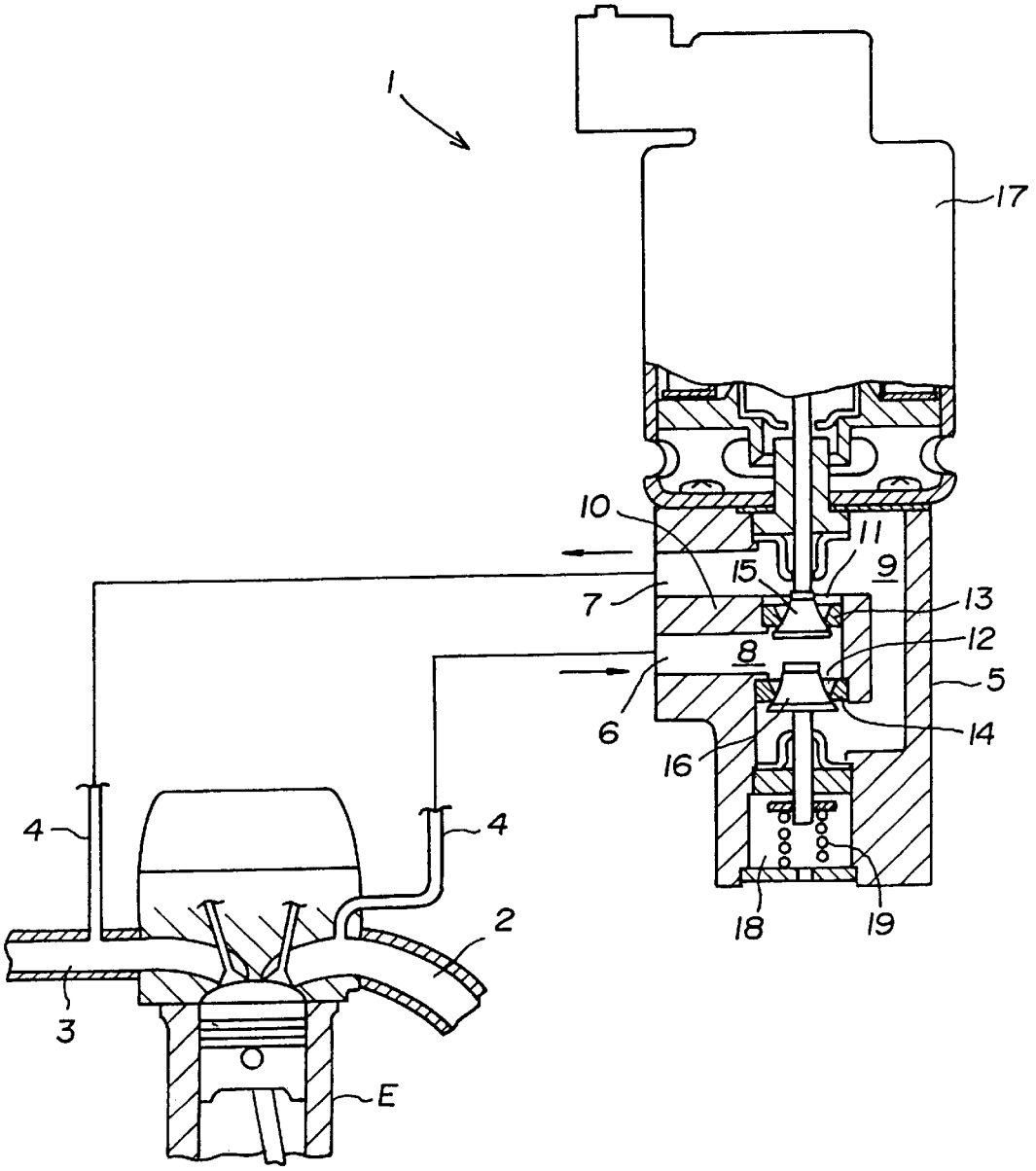
FIG. 1 is a schematic vertical cross-section drawing of an example of an exhaust circulation control valve according the present invention.

Referring to the drawings, the following is a description of the embodiments of the present invention.

FIG. 1 is a schematic vertical cross-section drawing showing an example of an exhaust circulation control valve according to the present invention.

As this drawing shows, an exhaust circulation control valve 1 is disposed in an exhaust circulation path 4 connecting an exhaust gas path 2 and an inlet path 3 of an engine E. Exhaust circulation path 4 is connected to inlet path 3 downstream from a throttle valve not shown in the drawing. An exhaust gas inlet port 6 connected to exhaust gas path 2 of engine E and an exhaust gas feed port 7 connected to inlet path 3 of engine E are disposed on a side surface of a valve housing 5 of exhaust circulation control valve 1. Exhaust gas feed port 7 is disposed further up (in the drawing) from exhaust gas inlet port 6. Exhaust gas inlet port 6 is continuous with an exhaust gas inlet chamber 8 which extends to a position a little past the center axis line of valve housing 5. Exhaust gas feed port 7 is continuous with an exhaust gas outlet chamber 9 which surrounds exhaust gas inlet chamber 8. A cylindrical partition wall 10 is disposed as a partition between exhaust gas inlet chamber 8 and exhaust gas outlet chamber 9. A first opening 11 and a second opening 12 are disposed facing each other at an upper and lower portion of partition wall 10. First opening 11 is disposed at a position closer to exhaust gas feed port 7 than second opening 12. Openings 11, 12 are positioned roughly along the center axis line of valve housing 5.

Thus, exhaust gas inlet port 6 and exhaust gas feed port 7 are made continuous with each other via separately disposed openings 11, 12.

Valve seats 13, 14 are attached to openings 11, 12, respectively. Valves 15, 16 are disposed in openings 11, 12 respectively so that they can be driven up and down relative to corresponding valve seats 13, 14. Valves 15, 16 are both formed in the shape of cones each having a center axis line roughly along the center axis line of valve housing 5. Valves 15, 16 seal openings 11, 12 by coming into tight contact with valve seats 13, 14. When valves 15, 16 are lifted, a gap is formed with valve seats 13, 14. The area of this gap varies according to the lift of valves 15, 16.

Openings 11, 12, which provide continuity between exhaust gas inlet port 6 and exhaust gas feed port 7, are opened and closed by valves 15, 16, which are disposed roughly coaxially with the direction in which the valves operate, thus controlling the amount of flow.

A drive mechanism 17 is attached to the upper end surface of valve housing 5 in order to drive first valve 15 (the upper valve). Drive mechanism 17 is formed from a conventionally known electric solenoid. A current is fed to the electromagnetic coil contained in drive mechanism 17 based on the operating state of the engine. This provides high-precision activation of first valve 15 based on the operating state of the engine. Second valve 16 (the lower valve) is kept pressed toward valve seat 14 via a spring 19 of a spring chamber 18 disposed at the lower end of valve housing 5. Second valve 16 is usually kept in a closed state. Spring chamber 18 is continuous with the outside atmosphere.

The following is a description of the operations of exhaust circulation control valve 1 configured as described above.

When engine E is running, the exhaust gas generated in the combustion chamber of engine E is let out via exhaust gas path 2. In this process, a portion of the exhaust gas passes from exhaust gas inlet port 6 of exhaust circulation control valve 1 to exhaust gas inlet chamber 8 via exhaust circulation path 4. When engine E is running, a current corresponding to the operating state at the time is fed to the electromagnetic coil of drive mechanism 17. First valve 15 is driven by drive mechanism 17, and valve 15 is lifted by an amount appropriate for the current operating state of the engine. Thus, first opening 11 opens and the exhaust gas in exhaust gas inlet chamber 8 flows through opening 11 into exhaust gas outlet chamber 9.

If, for example, the automobile is running normally, a relatively small current is fed to the electromagnetic coil in drive mechanism 17 and the lift at first valve 15 is small. Thus, second valve 16 is kept in a state where opening 12 is closed, and only first opening 11 is opened. As a result, the exhaust gas in exhaust gas inlet chamber 8 flows to exhaust gas outlet chamber 9 via the gap formed at valve seat 13 due to the lifting of first valve 15. The exhaust gas is then guided from exhaust gas feed port 7 to inlet path 3 of engine E via exhaust gas circulation path 4.

Thus, in this case a relatively small amount of exhaust gas is controlled with a high degree of precision via first valve 15 and is circulated to the inlet system of engine E.

When the engine is under a heavy load, a relatively large current is fed to the electromagnetic coil in drive mechanism 17 so that there is a large amount of lift at first valve 15. When this happens, valve 15 comes into contact with the head of second valve 16, which is disposed coaxially with valve 15, so that second valve 16 is pushed downward in opposition to spring 19. As a result, second opening 12 is opened as well, and the exhaust gas in exhaust gas inlet chamber 8 flows to exhaust gas outlet chamber 9 via both first and second openings 11, 12. Thus, a large amount of exhaust gas is circulated through inlet path 3 of engine E.

Second valve 16 is therefore activated by first valve 15, and valves 15, 16 allow a large amount of exhaust gas to be circulated through inlet path 3 of engine E.

Figure 2:
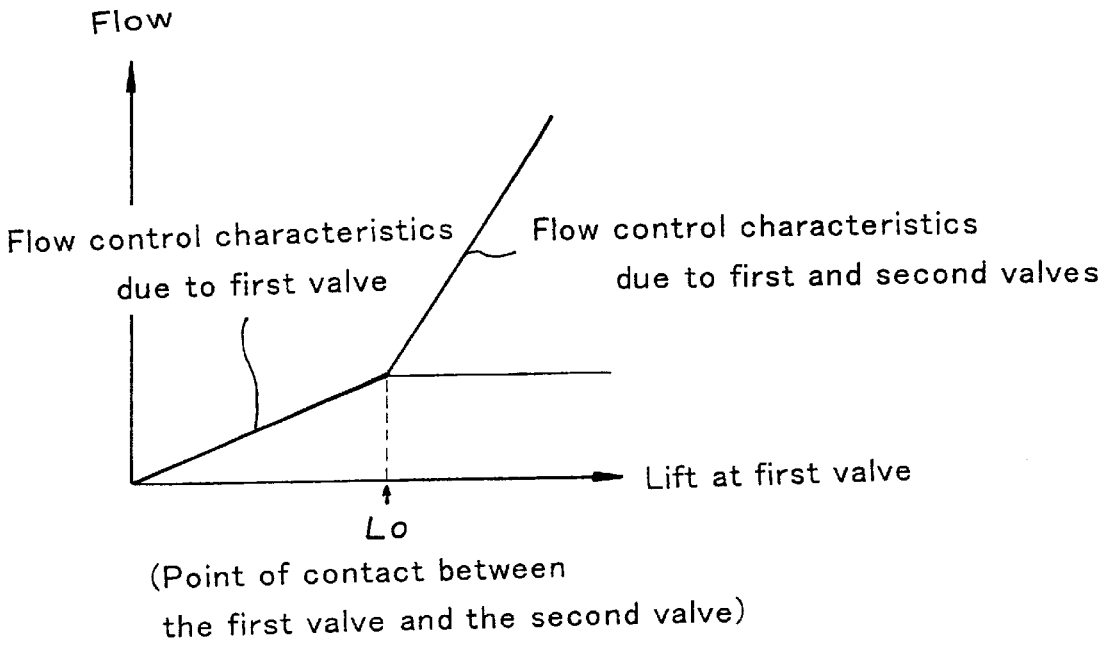
FIG. 2 is a graph showing the flow control characteristics the exhaust circulation control valve.

With exhaust circulation control valve 1 as described above, a small amount of lift at first valve 15 will result in only first opening 11 opening. If the lift is at or greater than a prescribed value, both first and second openings 11, 12 are opened. Referring to FIG. 2, the changes in the flow control characteristics take place in two stages. When only first valve 15 is active, the change in flow is kept small while control precision is kept high. By changing the lift on second valve 16, the change in flow can be increased so that a large flow can be controlled. In other words, exhaust circulation control valve 1 can have both low-flow control characteristics and large-flow control characteristics.

The turning point in flow characteristics, i.e., lift L0 of first valve 15 where first valve 15 comes into contact with second valve 16, can be adjusted based on the characteristics of engine E.

In exhaust circulation control valve 1, second valve 16 is driven by first valve 15 so that no external drive mechanism for driving second valve 16 is required. Thus, the structure can be made more simple and compact.

When the lift on first valve 15 is at prescribed value L0 or higher, valve 15 comes into contact with second valve 16, and the resulting impact causes carbon adhered to valves 15, 16 to peel off. Thus, reduction in flow control precision due to carbon adhesion is prevented.

The exhaust gas in exhaust gas inlet chamber 9 is guided into inlet path 3 by the negative pressure at the inlet pipe of engine E. Thus, the exhaust gas that flows into exhaust gas outlet chamber 9 from first opening 11 does not flow to second opening 12 and instead flows directly out from exhaust gas feed port 7. Also, the exhaust gas that flows into exhaust gas outlet chamber 9 from second opening 16 converges directly downstream from first opening 11 with the exhaust gas that flows out from first opening 11. Thus, the path from second opening 12 to first opening 11 is kept at a relatively high temperature, and the overall temperature of valve housing 5 is kept uniform. The accumulation of carbon in exhaust gas is pronounced in low temperatures, so the accumulation of carbon within exhaust gas outlet chamber 9 is prevented. In particular, the adhesion of carbon to second valve 16, which is not activated often, is prevented.

Figure 3:
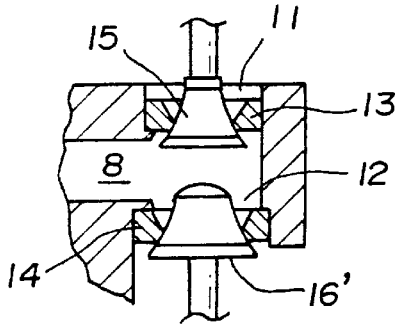
FIG. 3 is a side-view drawing showing an alternative embodiment of the valve used in the exhaust circulation control valve.

FIG. 3 shows an alternative embodiment of the second valve.

In this case, the head of second valve 16' is formed as a projection with a curved surface such as a spherical surface. This type of structure results in an increase of surface pressure when first valve 15 comes into contact with second valve 16'. Thus, adhered carbon can peel away more easily, and the adhesion of carbon to the head of second valve 16', which is exposed to exhaust gas in exhaust gas inlet chamber 8, can be further reduced.

The embodiment above describes an arrangement where first valve 15 and second valve 16 are disposed coaxially. However, it would also be possible to have valves 15, 16 positioned so that they are not coaxial as long as second valve 16 is activated when there is a prescribed lift at first valve 15.

As described above, the present invention provides a structure wherein openings are formed at a plurality of positions to make the exhaust gas inlet port and the exhaust gas feed port continuous. These openings are opened and closed using corresponding valves. Thus, a single exhaust circulation control valve can have both high-precision low-flow control characteristics as well as responsive large-flow control characteristics. When one of the valves is activated to a prescribed lift or higher, the valve activates another valve. Thus, there is no need for separate external drive mechanisms to activate each of the valves, and a compact exhaust circulation control valve with a simple structure is possible.

By having the valves disposed coaxially in the direction of operation of the valves, the activation of a single valve to a prescribed lift or higher causes the valve to come into contact with another valve so that the valve directly activates the other valve. If carbon is adhered to the valves, the carbon can easily peel off. Thus, an exhaust circulation control valve having a simple structure and having minimal carbon adhesion can be provided.

This makes it possible to provide an exhaust circulation control valve having a simple structure that can achieve consistently high-precision control of exhaust gas circulation over a wide range of conditions under which the automotive engine is operated.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed:

1. An exhaust circulation control valve comprising:

an exhaust gas inlet port connected to an exhaust gas path of an engine which lets in a portion of an exhaust flowing through said exhaust gas path;

an exhaust gas feed port connected to an inlet path of said engine which guides said exhaust gas flowing from said exhaust gas inlet port into said inlet path; and at least first and second openings being opened and closed based on the operating state of said engine thereby permitting the exhaust gas to circulate in the inlet system of the engine;

wherein said at least first and second openings are disposed at a plurality of positions, wherein said exhaust circulation control valve further comprises at least first and second valves which open and close said at least first and second openings, respectively, and wherein said first valve is driven by a drive mechanism, and said second valve is driven in tandem with the first valve so as to be lifted when said first valve has a prescribed lift or higher, so that the exhaust gas flows via both said at least first and second openings.

2. An exhaust circulation control valve as recited in claim 1 wherein:

said valves comprise heads formed in the shape of a curved projection.

3. An exhaust circulation control valve as recited in claim 1 or claim 2 wherein:

said valves are disposed roughly coaxial to the direction in which said valves operate.

4. An exhaust circulation control valve as recited in claim 1 or claim 2 further comprising:

a member for allowing said valves to operate in tandem.

5. An exhaust circulation control valve as recited in claim 1 wherein:

a lift of said first valve when said second valve is begun to left can be adjusted based on the characteristics of said engine.

6. An exhaust circulation control valve as recited in claim 1 wherein:

said second valve is kept pressed toward a valve seat via a spring so that said second opening is usually kept in a closed state, and is driven by said first valve to open said second opening.

7. An exhaust circulation control valve as recited in claim 1 wherein:

said exhaust gas that flows out from said second opening converges directly downstream from said first opening with said exhaust gas that flows out from said first opening.

* * * * *